US007780817B2

(12) United States Patent
Hellstrom

(10) Patent No.: US 7,780,817 B2
(45) Date of Patent: Aug. 24, 2010

(54) MEASUREMENT SYSTEM FOR IMPROVED PAPER ROLL RUNNABILITY

(75) Inventor: Ake Hellstrom, Columbus, OH (US)

(73) Assignee: ABB Ltd., Dublin (IE)

( * ) Notice: Subject to any disclaimer, the term of this patent is extended or adjusted under 35 U.S.C. 154(b) by 354 days.

(21) Appl. No.: 11/964,121

(22) Filed: Dec. 26, 2007

(65) Prior Publication Data

US 2008/0210396 A1 Sep. 4, 2008

Related U.S. Application Data

(62) Division of application No. 11/127,633, filed on May 12, 2005, now abandoned.

(51) Int. Cl.
*D21F 11/00* (2006.01)

(52) U.S. Cl. ..... 162/198; 162/263; 73/159

(58) Field of Classification Search ..... 162/198, 162/263; 73/159, 823, 868, 37.7; 33/501.02
See application file for complete search history.

(56) References Cited

U.S. PATENT DOCUMENTS

| | | | | |
|---|---|---|---|---|
| 5,029,469 | A | 7/1991 | Chase et al. | |
| 5,052,233 | A | 10/1991 | Rantala | |
| 5,479,720 | A | 1/1996 | Hellstrom et al. | |
| 5,649,448 | A * | 7/1997 | Koskimies et al. | 73/159 |

* cited by examiner

*Primary Examiner*—Mark Halpern
(74) *Attorney, Agent, or Firm*—Michael C. Prewitt

(57) ABSTRACT

A method for measuring both caliper and tension of a web such as paper wound into a roll. The method may include a standard caliper sensor whose air supply is selectively modified to allow for both the measurement of caliper and tension of the web. In another embodiment two similar or identical measurement devices are installed in tandem where one device measures tension without pinching the sheet and the other device measures caliper. The sensor may include two sheet guides for providing support for tension measurement or one or both sheet guides can be eliminated by support from machinery rolls.

10 Claims, 9 Drawing Sheets

Prior Art

MEASUREMENT SYSTEM FOR IMPROVED PAPER ROLL RUNNABILITY

CROSS-REFERENCE TO RELATED APPLICATION

This application is a divisional patent application of, and claims priority from, U.S. patent application Ser. No. 11/127,633, which is hereby incorporated by reference in its entirety.

FIELD OF THE INVENTION

This invention relates to paper rolls and more particularly to the runnability of a paper roll.

DESCRIPTION OF THE PRIOR ART

Paper products are typically shipped in large rolls from the paper mill to a converting or printing facility. The paper quality can be characterized by sheet properties, for instance thickness, basis weight, moisture content or strength, but there are additional mechanical properties of the paper roll as an entity that are equally important for the user. These additional mechanical properties are often referred to as "roll runnability", designating how well the roll unwinds and pulls though the process, and the flatness and uniformity of the resulting web. For instance, if there is a local tension variability in the roll, the resulting web may become locally wrinkled or tend to pull diagonally instead of straight, or even break at localized high tension areas.

Rolls from different paper machines or made at different times or locations of a machine may have different runnability characteristics. For example, some rolls may tend to pull diagonally left and other rolls may tend to pull right. The converting or printing machinery may in some cases be adjusted to partially correct for a particular runnability condition, but that machinery cannot economically be re-adjusted between rolls.

There is thus a rising concern in converting plants and at printing houses, that, because of the roll runnability characteristics, different paper rolls delivered from different paper machines may result in poor end product quality and sheet breaks. Runnability problems of a paper roll may occur despite acceptable test values for sheet quality properties in each roll of paper. Therefore, it is desirable to better quantify runnability properties of rolls.

Several methods have been suggested to measure and control runnability quality of paper rolls. On-line paper reel hardness sensors were on the market in the 1970's. This included the "Back Tender's Friend", utilizing a design originated by Consolidated-Bathurst, Inc., and built by a few gauging suppliers including AccuRay Corporation, now part of ABB, and similar solutions that mechanically inspect the reel as it is being built. These reel mechanical inspection solutions measure the local roll hardness by the force impulse generated by a contacting and traversing small roller sensing device in contact with the roll periphery including piezoelectric signal transducers that can estimate the hardness profile. These reel mechanical inspection solutions add cost and complexity to the papermaking process.

Improved caliper sensors came on the market in the 1980's and 1990's and enabled closed loop caliper profile control. One example of an improved caliper sensor is disclosed in U.S. Pat. No. 5,479,720 ("the '720 patent") which is assigned to the assignee of the present invention and the disclosure of which is hereby incorporated herein by reference. Similar devices are now standard equipment on many paper machines. By automatic control of the caliper profile, reel building improves due to a more uniform contact surface between the layers of paper. However, caliper information only is not adequate to predict the mechanical runnability properties of a paper roll being built. The web tension is also essential.

The total web tension is today easily measured via motor torque or via load cells on lead rolls for the paper web. This information can be used to control the roll building process for proper nominal tension. However, the tension has a cross directional profile. Portions of the web may be slack and other portions may have high tension streaks. If the tension is not uniform across the web, the sheet will not wind in a proper cylindrical shape and the non-uniform tension will cause ridges, wrinkles and hard versus soft areas in the paper roll.

The reasons for an uneven web tension profile includes a CD dependent fiber orientation, pressing, drying and rewetting of the paper. Cross machine moisture control to level the moisture profile at the reel may not always help and in some cases worsen the tension profile by shrinking or expanding the sheet dimensions.

Good reel building is particularly difficult on thin or moderate thickness paper grades due to a large number of wraps and low bending stiffness of the sheet.

A stand-alone web tension profile sensor can be produced by installing a stationary beam where the sheet wraps around stationary sensing devices, for instance an array of air orifices. This is described in U.S. Pat. No. 5,052,233. Drawbacks of these devices include high cost, extra space needed in the paper machine, and impairing threading of the paper. Additionally, the signal handling to combine tension and caliper information for a roll quality estimate becomes complex.

Another solution of including multiple caliper sensors each pinching the sheet from both sides, and utilized for web tension measurement and correction for a contacting sheet stiffness sensor has been suggested. This is described in U.S. Pat. No. 5,029,469. This solution is complex, and it did not generate much success.

Due to the general industry acceptance of modern caliper sensors, there is today a caliper sensor on virtually every paper machine where reel building is essential. The present invention shares this caliper sensor hardware for reel tension measurement and merges the caliper and tension information into a prediction of roll hardness uniformity.

SUMMARY OF THE INVENTION

A method for measuring in a direction across a moving web both tension and caliper of the moving web comprising:

using a single sensor to measure tension and caliper of the moving web at a location on the moving web;

providing support for the moving web before and after the location on the moving web where the single sensor measures tension and caliper of the moving web; and controlling the single sensor to alternate between two operating modes where in one of the two operating modes the single sensor measures caliper of the moving web and in another of the two operating modes the single sensor measures tension of the moving web.

A single sensor for measuring in a direction across a moving web both tension and caliper of the moving web at a location on the moving web comprising:

means for operating the single sensor to alternate between the caliper measurement and the tension measurement.

A method for measuring in a direction across a moving web both tension and caliper of the moving web comprising:

using two sensors in tandem to measure at a location on the moving web tension of the moving web by one of the two sensors and caliper of the moving web by another of the two sensors.

A system for measuring at a location on a moving web both caliper and tension of the moving web comprising:

a sensor for measuring caliper of the moving web in tandem with a sensor for measuring tension of the moving web;

at least one guide associated with the sensor for measuring tension of the moving web to support the moving web during the tension measurement.

A quality control system for a web making machine comprising:

a scanning frame having an opening through which a moving web passes;

a sensor mounted in the scanning frame for measuring at locations across the moving web both tension and caliper of the moving web, the scanning frame operable to cause the sensor to move back and forth across the moving web; and means for operating the sensor to alternate between the caliper measurement and the tension measurement.

A web making machine comprising:

a system for controlling quality of the web comprising:

a scanning frame having an opening through which a moving web passes;

a sensor mounted in the scanning frame for measuring at locations across the moving web both tension and caliper of the moving web, the scanning frame operable to cause the sensor to move back and forth across the moving web; and means for operating the sensor to alternate between the caliper measurement and the tension measurement.

DETAILED DESCRIPTION

Figure 1:
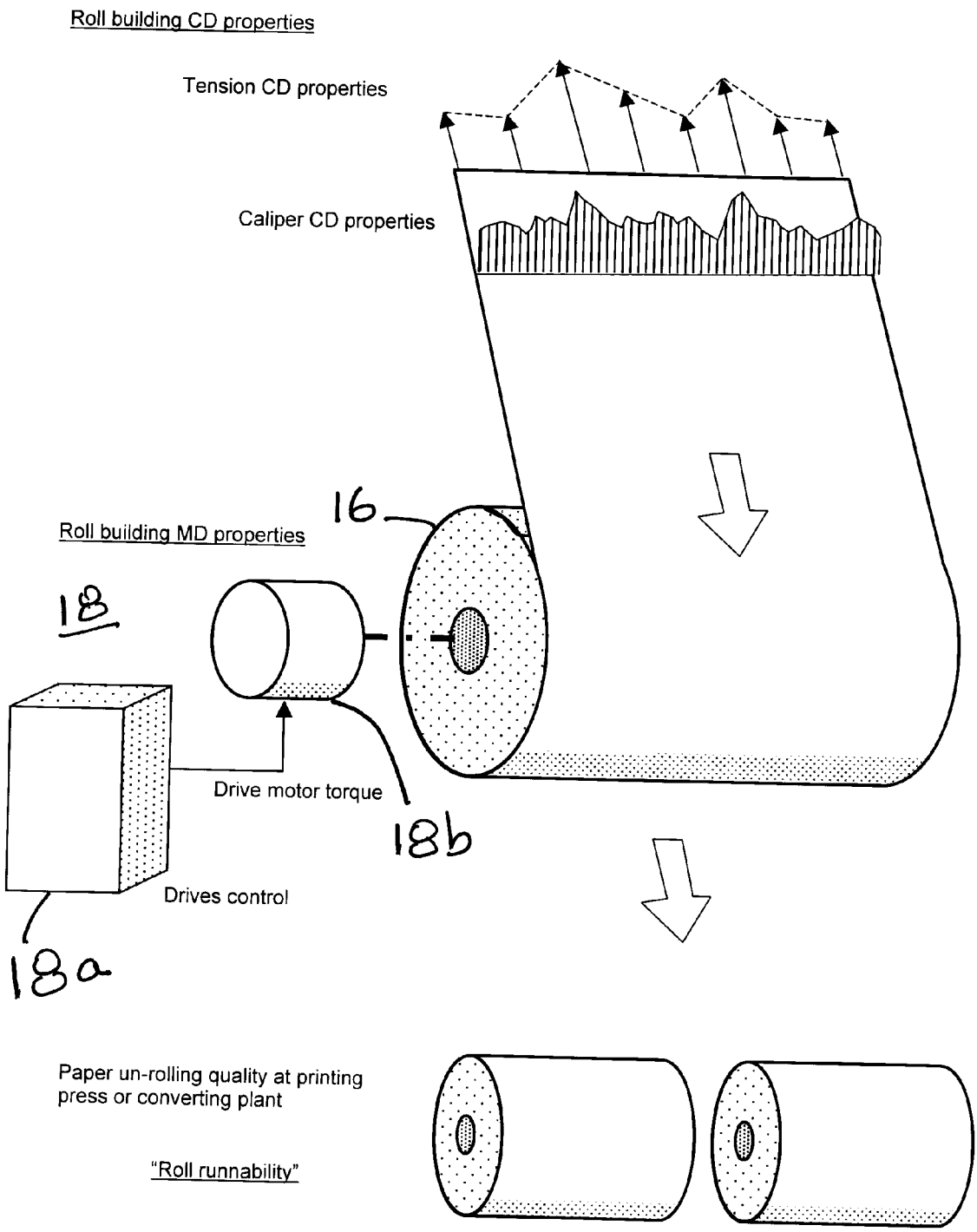
FIG. 1 shows a schematic view of winding a reel from a web material.

As is illustrated in FIG. 1, the qualities of a wound paper roll 16 are significantly influenced by the web CD caliper profile, the CD tension profile, and well as the overall tension level in the MD. An un-even caliper CD profile causes layers of paper to contact at high thickness CD locations and to have loose contact or air gaps at low thickness locations. With a relatively stable CD profile, the errors accumulate due to a very large number of wraps in a large diameter paper roll. The accumulated errors may result in a non cylindrical shape and localized hard and soft areas on the roll. The effect of uneven thickness profile is often worse on thin paper grades where the number of wraps become large. For instance, a full newsprint reel in a paper machine may have 15,000 wraps of paper.

The other important factor for roll building is the web tension. This has two components—the tension CD profile and the overall MD tension. The CD profile may be caused by un-even drying or re-moisturizing of the paper web in the CD direction, un-even fiber orientation from the wet end, and related shrinkage effects. As illustrated in FIG. 1, overall MD tension can be managed by motor drive controls 18 which includes controller 18*a* and drive motor 18*b*. The CD profile superimposes localized high tension or low tension areas of the paper winding process. The tension profile may cause hard spots or soft spots on the reel, or tendency to skew the web, web overstressing and even failure at high tension areas.

Figure 2:
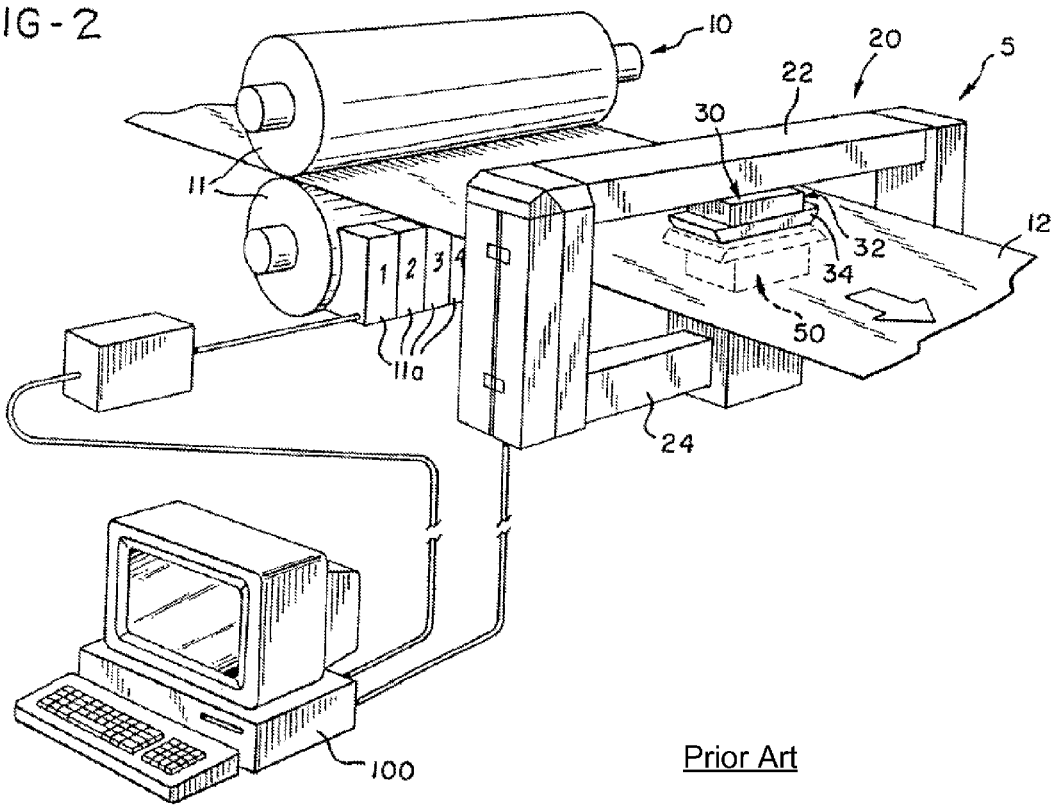
FIG. 2 shows a conventional paper making machine including the caliper and tension measuring system of the present invention.

FIG. 2, which is FIG. 1 of the '720 patent, shows a conventional paper making machine 10 having final calendering rolls 11 and associated cross machine control actuators 11*a*. A caliper and tension measuring system 5 constructed in accordance with the present invention is preferably positioned downstream from the final calendering rolls 11 and is advantageously used to monitor the thickness and tension of a moving sheet of paper 12 after the final calendering operation.

The caliper and tension measuring system 5 includes a scanning station 20. The moving sheet of paper 12 can be seen passing through the scanning station 20 between upper and lower transverse beams 22 and 24 on which are mounted upper and lower sensing heads 30 and 50. The sensing heads 30 and 50 are driven back and forth across the width of the paper 12 in a continuous scanning motion, keeping them in substantial alignment at all times.

The signals from the sensing heads 30 and 50 and the scanning station 20 are communicated to processing computer 23 that provides operator display and process control. Signals from computer 100 are sent to actuators 11*a* to control the thickness of paper 12. Computer 100 and associated actuators 11*a*, sensing heads 30, 50 and scanner 12 are known as a quality control system.

Figure 3:
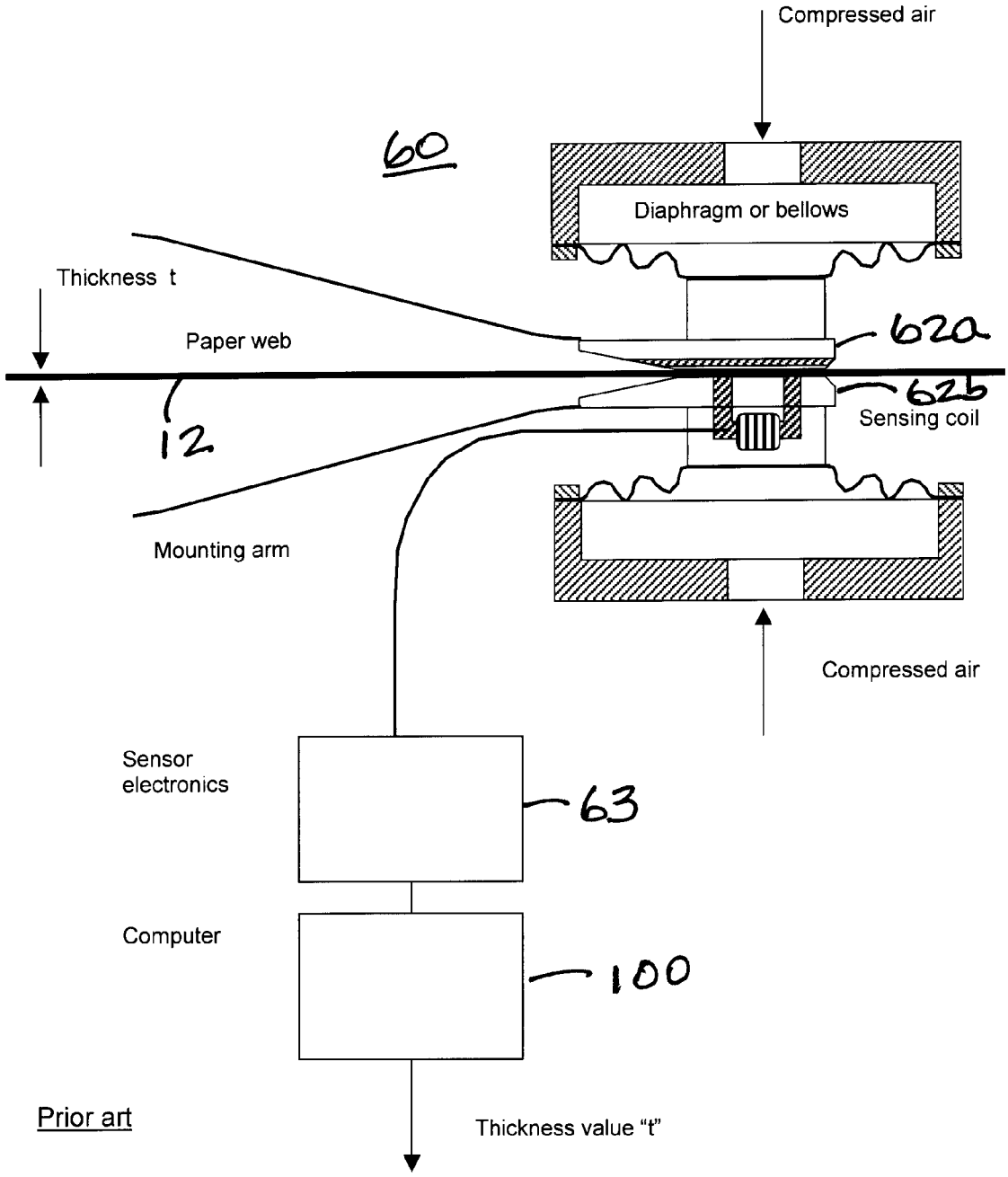
FIG. 3 shows a prior art caliper sensor.

In order to provide a cost effective, simple and reliable means of measuring web tension as well as caliper, a standard caliper sensor 60, known from the prior art and shown in FIG. 3, can in accordance with the present invention be provided with the additional features described herein to measure web tension. Sensor 60 measures web thickness by means of a pair of sensing planes 62*a*, 62*b* contacting the web or sheet 12 from both sides, and includes a magnetic based measurement of the distance for the sensing planes 62*a*, 62*b* in order to provide the web thickness.

Sensor 60 is mounted in a scanner (not shown in FIG. 3 but well known to those of ordinary skill in the art such as scanning station 20 shown in FIG. 2 herein) that permits travel across the web 12 to measure a cross direction (CD) thickness profile of the web 12. In order to provide measurement of web thickness, appropriate sensor electronics 63 and a computer 100 are added to convert magnetic sensing element signals and accurately display process thickness units. Such a scheme is described for instance in the '720 patent.

Figure 4:
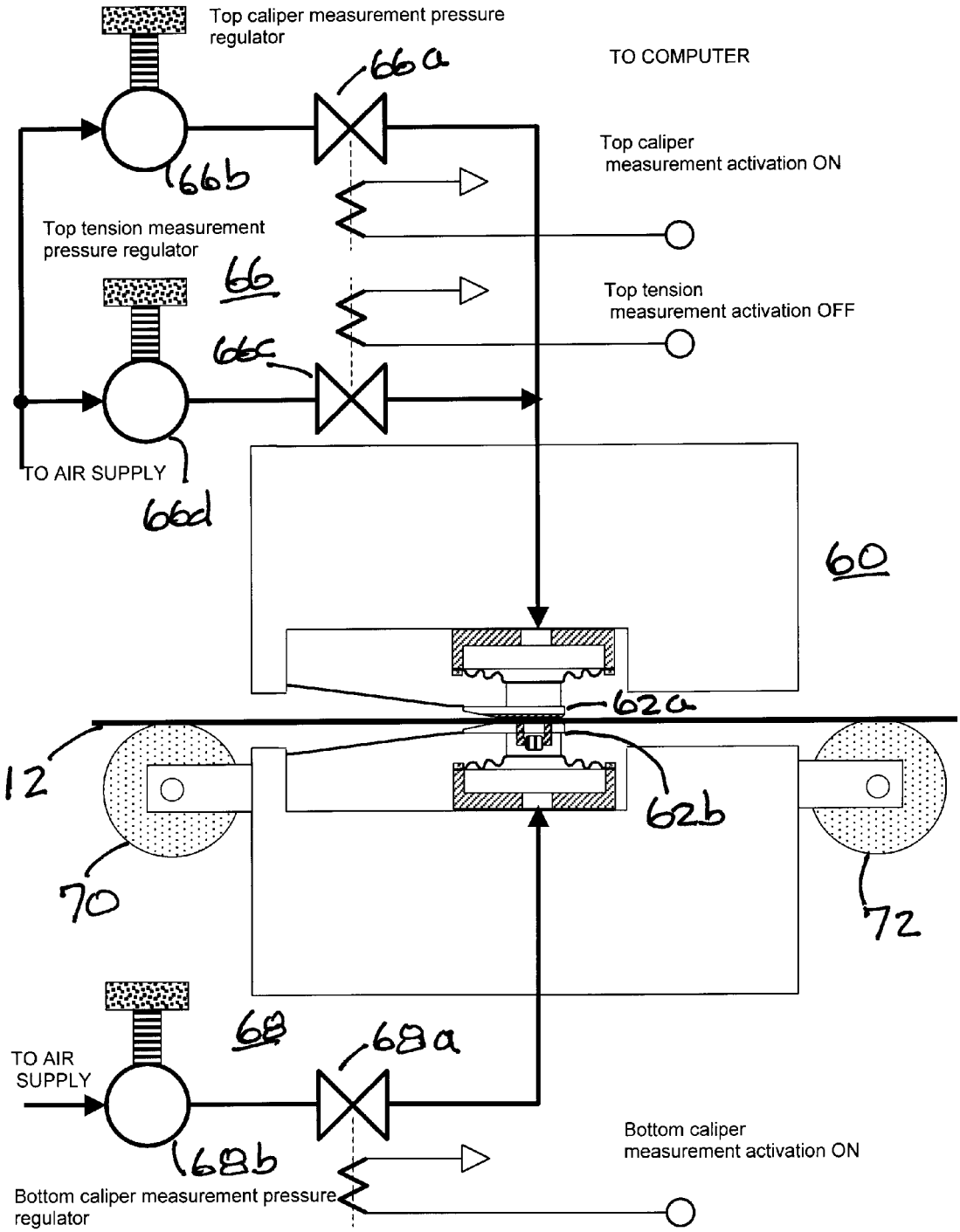
FIG. 4 shows the prior art caliper sensor and air supply modified in accordance with the present invention.

FIG. 4 shows the prior art caliper sensor 60 with associated air supply 66, 68 for the top and bottom caliper measurement, respectively. Valves 66*a*, 68*a* and pressure regulators 66*b*, 68*b* allow for extension and retraction of the sensing planes 62*a*, 62*b* so that sensor 60 can measure the caliper of web 12. Not shown in this illustration are retraction springs or other devices that pull the sensing planes 62*a*, 62*b* away from the sheet.

In accordance with the present invention, and as is described in more detail in connection with FIG. 4, the air supply systems 66, 68 include additional features for alternate pressure selection for at least one of the sensing planes. The alternate pressure setting is utilized for tension measurement and is provided by the combination of valve 66*c* and pressure regulator 66*d*.

FIG. 4 also shows sheet guides 70, 72 before and after the caliper and tension measurement. These guiding devices 70, 72 can be distant from or near the caliper measurement and may consist of rollers, sliding contact bars, or non contacting air bearings.

Figure 5:
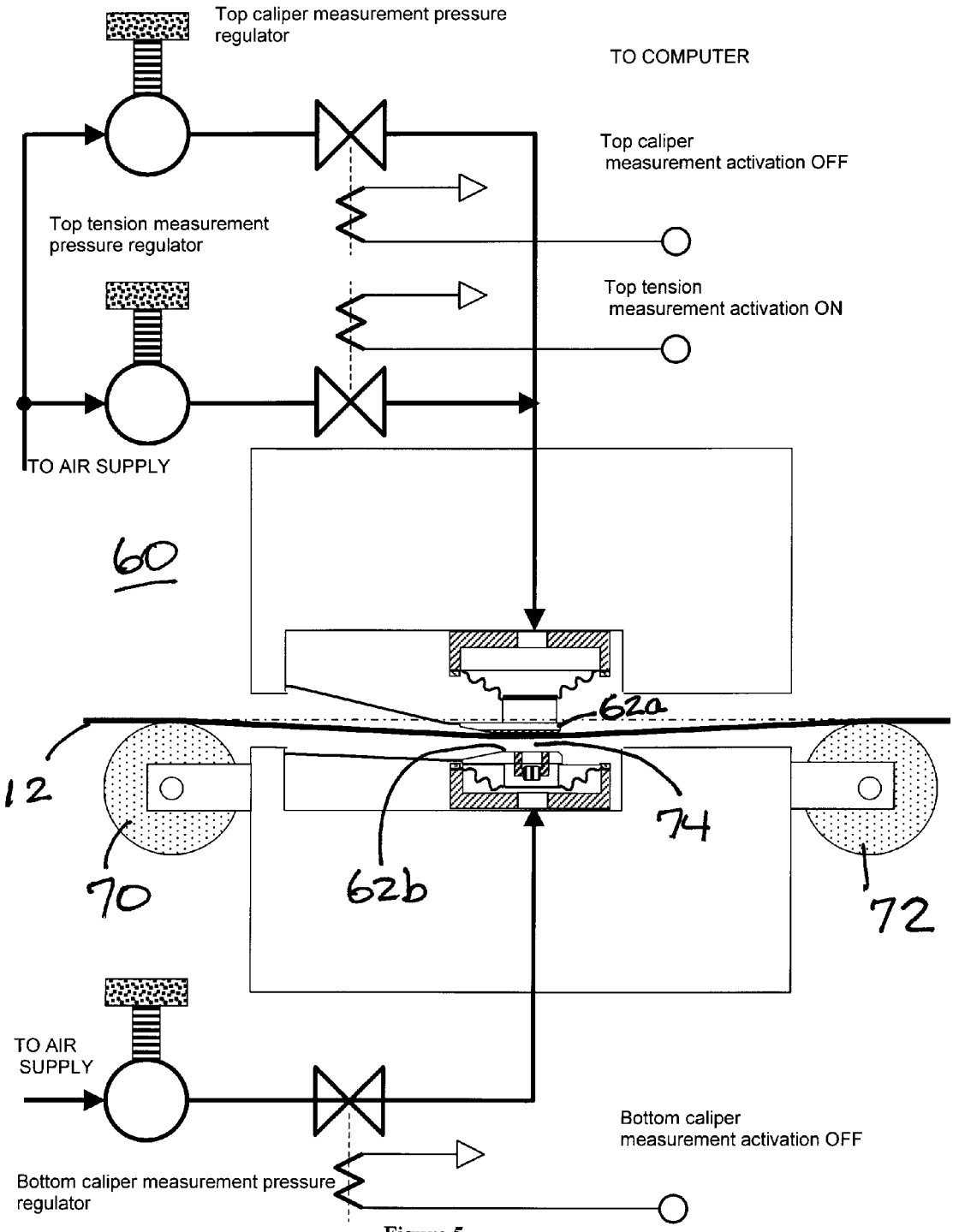
FIG. 5 shows the sensor of FIG. 4 activated to measure web tension.

FIG. 5 shows the sensor 60 of FIG. 4 in a state where the alternate pressure settings are activated to allow web tension measurement. The lower sensing plane 62*b* is de-activated and retracted in the sensor. The upper sensing plane 62*a* is activated with an alternate pressure setting to permit a light touch deflection of the web 12. The pressure in upper half of sensor 20 is chosen to introduce a measuring gap 74 between upper and lower sensing planes 62*a*, 62*b* that is significantly larger than the web thickness, but yet introduces a measurable deflection of the web 12. For instance, the web thickness on fine writing paper may be 0.1 mm, while the gap between the sensing elements that measure paper deflection is of the magnitude of 4 mm. In general, the measuring gap 74 between the sensing planes 62*a*, 62*b* should be at least 10 times the thickness of the web 12.

The measuring gap 74 between the sensing planes 62*a*, 62*b* is indicative of the sum of caliper and web tension effects. This distance is measured by the same devices that measure caliper. If the thickness of the sheet 12 is very small compared to the gap distance for sensing tension, caliper may be neglected. For caliper values that are larger, the most recent caliper profile may be subtracted from the tension measurement.

In the device illustrated in FIGS. 4 and 5, control commands from a computer (not shown in either figure but typically the same as computer 100 shown in FIGS. 2 and 3) are used to activate the sensing pressures to, at user selectable intervals, alternate between caliper and web tension measurement mode. For example, the caliper profile may be measured during 20 scans across the web 12, followed by a measurement of the web tension profile for one scan, with this alternating measurement continuously repeated. The web tension CD profile is believed to have less dynamic variability than the caliper CD profile, and thus it may not need to be updated at a very high rate. Of course, user demand can also be used to issue control commands that activate the sensing pressures to alternate between caliper and web tension measurement mode.

Figure 6:
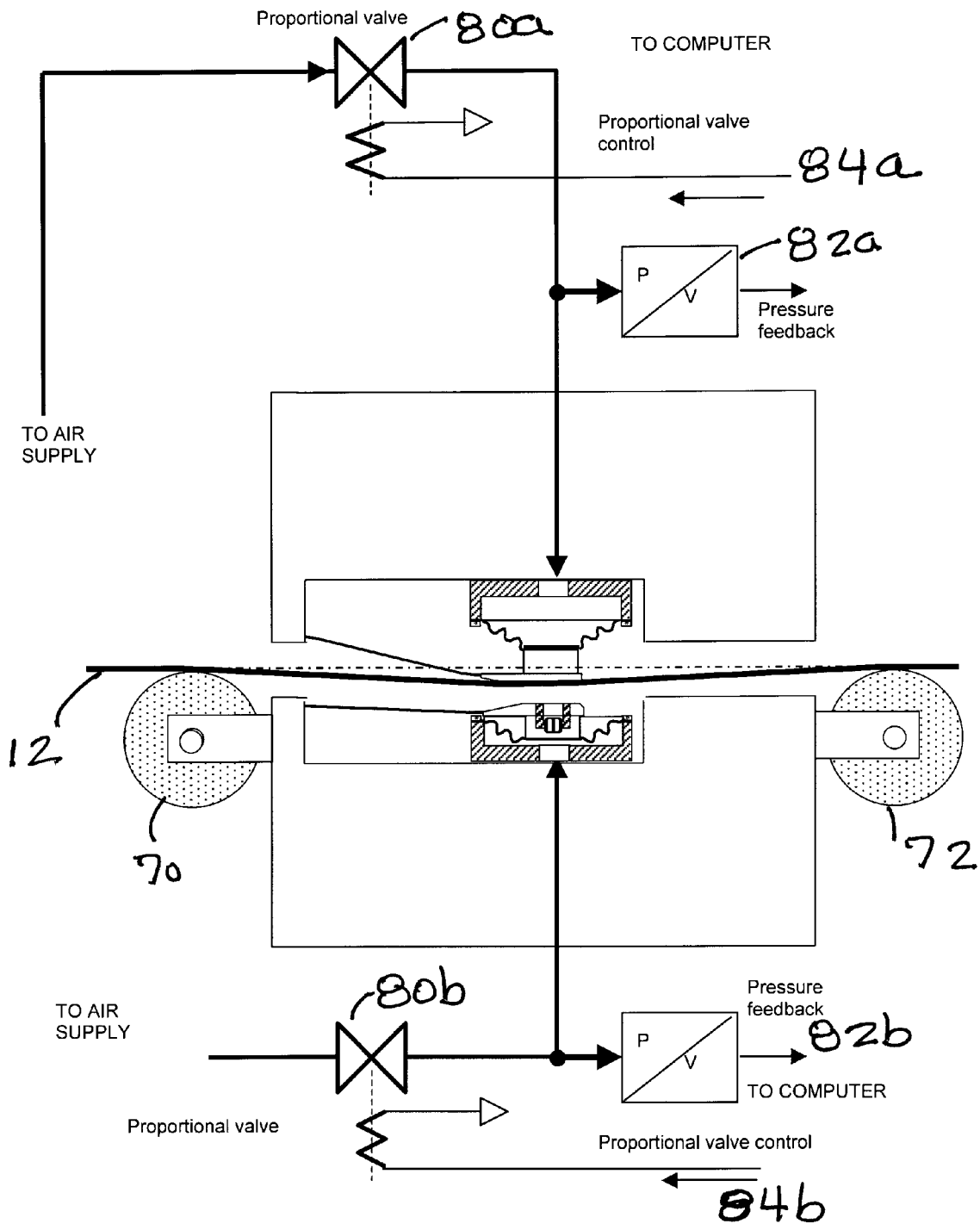
FIG. 6 shows another embodiment for the caliper and tension measuring system of the present invention.

FIG. 6 shows an alternate method and apparatus for providing a computer selectable caliper and tension sensor air pressure. A continuously adjustable sensing pressure for each sensing plane is generated by proportional valves 80*a*, 80*b* under control of an associated signal 84*a*, 84*b* from a computer (not shown here but typically the same as the computer 100 shown in FIGS. 2 and 3), and with an associated feedback signal 82*a*, 82*b* for closed loop pressure control. This method and apparatus has less parts than the air supplies 66, 68 shown in FIGS. 4 and 5 and allows for a wide range of pressure settings that may be useful for paper processes with a wide range of product thickness.

Figure 7:
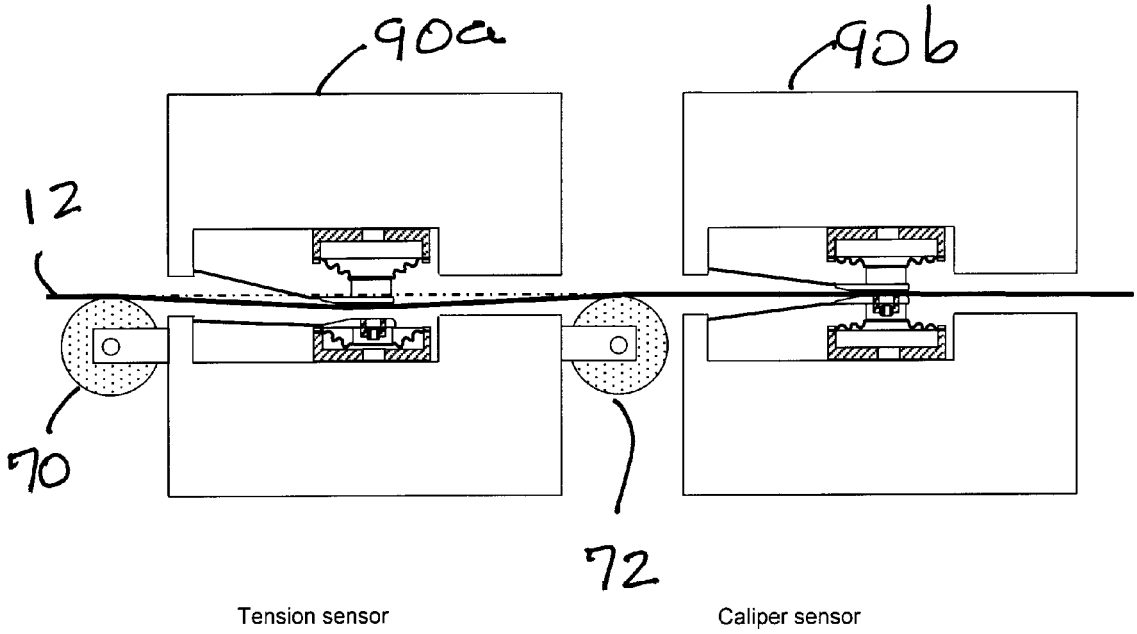
FIG. 7 shows a further embodiment for the caliper and tension measuring system of the present invention.

In another embodiment of the invention, two identical or similar measurement devices 90*a*, 90*b* may be installed in tandem to separately measure caliper at device 90*b* and tension at device 90*a* as illustrated in FIG. 7. While not shown in FIG. 7, those of ordinary skill in the art would understand that there are air supplies associated with the upper and lower sensing planes of sensor 90*b* to simultaneously extend both of those planes to measure caliper of the moving web 12 and an air supply associated only with one of the two sensing planes of sensor 90*a* to extend that plane to measure the tension of the moving web 12 without pinching the web. The air supply associated with one sensing plane of sensor 90*a* would be as shown in either FIG. 5 or 6 and measurement device 90*a* includes as is shown in FIG. 7 the sheet guides 70, 72. This tandem arrangement enables a non-interrupted measurement of both caliper and tension but it adds cost and requires more room in the paper machine.

Figure 8:
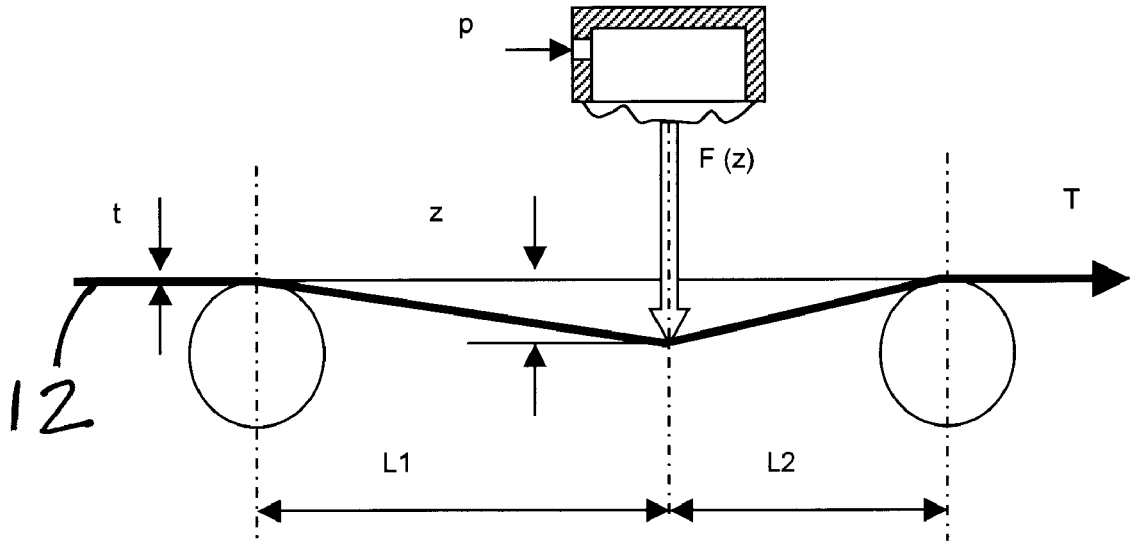
FIG. 8 shows the fundamental tension measuring geometry.

The fundamental tension measurement geometry is illustrated in FIG. 8. Consider a simple case where sheet 12 is thin, that is, printing grade paper such as for example newsprint and fine writing paper, the vertical deflection z is much larger than sheet thickness t, and the bending resistance from sheet stiffness is much smaller than the deflection resistance from web tension T. It is also assumed that the applied force F(z) is constant and does not depend on z. The assumption of a constant force for small deflections is reasonably well met with typical designs of the bellows or diaphragms activating sensing planes in a caliper sensor, however a more complex model that includes a non constant force vs. deflection of the bellows or diaphragms may be added for additional refinements. For the sake of simplicity of analysis it is assumed herein that the force is deflection independent.

The following simple geometry relation can then be derived for web tension T as a function of a constant vertical force F(z) and measured vertical deflection z:

$$T=F(z)/(1/(\mathrm{sqrt}((L1/z)^2+1))+1/(\mathrm{sqrt}((L2/z)^2+1)))$$

Figure 9:
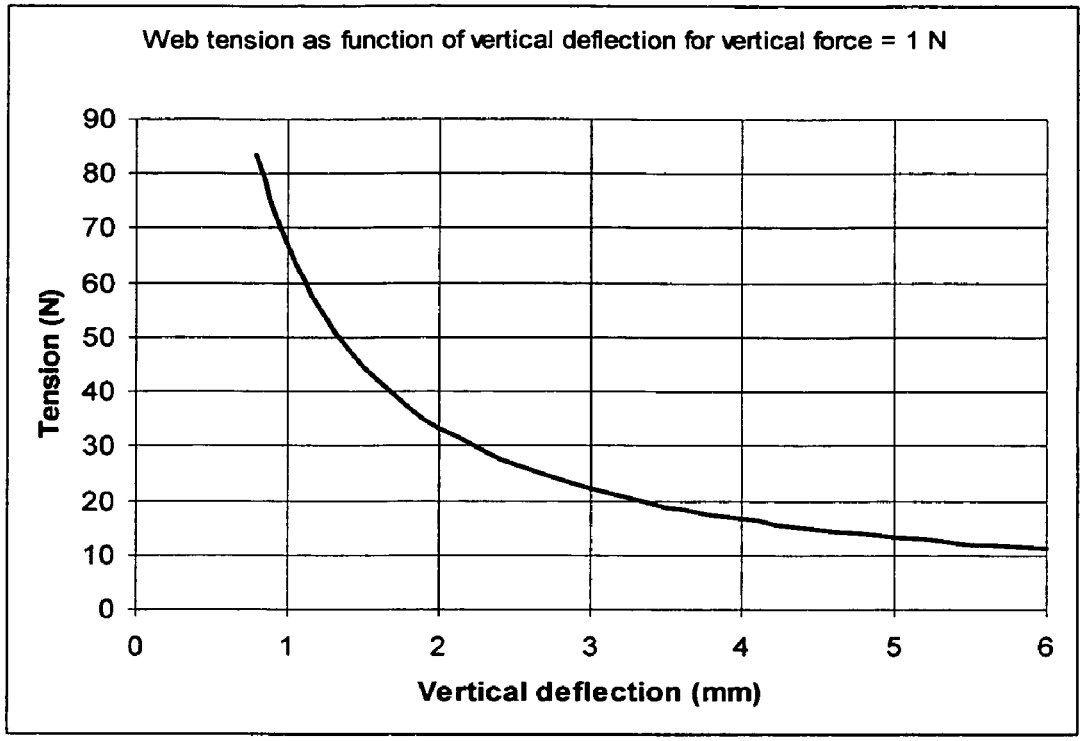
FIG. 9 shows a graph of tension versus vertical deflection.

This relation is illustrated in FIG. 9 for the parameters L1=200 mm, L2=100 mm, F(z)=1 Pa.

Figure 10:
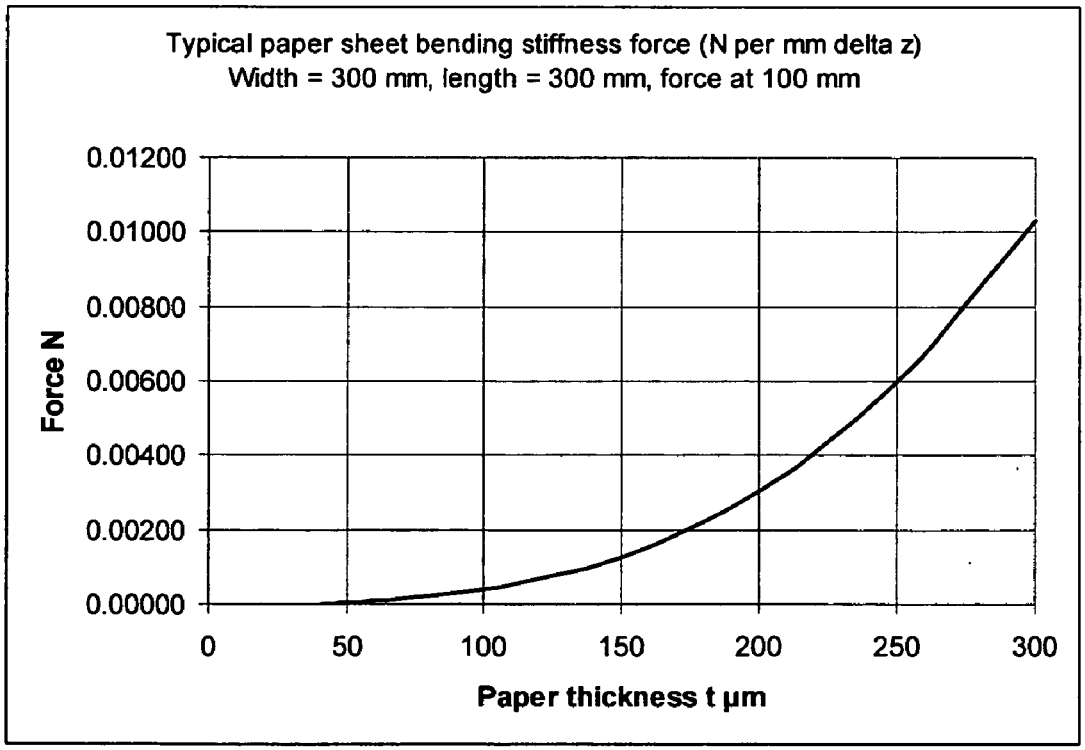
FIG. 10 shows a graph of force versus paper thickness.

The influence of sheet bending stiffness is illustrated in FIG. 10. This data was experimentally generated by applying a force on a paper sample with the same configuration as in FIG. 9. One primary data point was measured by the change in sag on an end supported 200 μm thick paper at 300×300 mm size for a load F(z) using a small weight. The curve is extrapolated up and down from this point by using the textbook relation for sheet bending deflection from a constant force:

$$\text{Deflection}=k/(\text{Paper thickness})^3$$

This formula assumes a homogeneous sheet without any layering and constant E-modulus. In reality, different paper types may deviate from this curve by ±50% or even more. The data thus should be used only for order of magnitude error estimate.

By comparison of the modeling results in FIG. 9 and FIG. 10, it can be concluded that for typical conditions of web tension and thickness, the bending resistance term may be neglected. For thicker paperboard products, for instance exceeding 150 or 200 μm, options exist to use a bending stiffness compensation term from measured caliper, or to extend the distance between the two sheet guides 70, 72. One extreme case of distance extension for very thick products includes elimination of one or both sheet guides 70 or 72 and only utilizing the paper machinery rolls for web support on one or both sides of the sensor.

With anticipation of the main need for runnability measurement for mainly thinner to medium thickness grades of paper, bending stiffness effects are not a main concern for the general usability of this invention.

Calibration of this sensor can be easily checked by placing a desired dimension sample strip through the sensor gap and pulling it by a constant force by using weights that pull one end of the sample hanging outside the sensor guide roll, and alternately measure caliper and web tension.

When measuring a web 12 of finite width, there will be edge effects on the profile due to less of the web material participating in sharing the tension near the edge. This is true for any local tension measurement device applied to a web 12 and it also reflects conditions applicable for roll building. A target profile may be generated for a suitable profile shape including edge effects.

In paper making environments, the combination of caliper and tension information across the web 12 may be utilized for improved characterization of roll quality. This information can also be applied for improved automatic controls using existing web profile actuators. Additionally, the invention can be connected to communicate with a paper machine drive system, such as for example, controller 18*a* and drive motor 18*b* of FIG. 1, or winder machine for improved tension characterization and control to build more uniform paper rolls.

Although the embodiments in this description are related to contacting caliper sensors the invention may also utilize air bearing based non contacting caliper sensors. Furthermore, the invention is applicable to any web thin material including coated products or extruded plastics sheets.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A method for measuring in a direction across a moving web both tension and caliper of said moving web comprising:

using a single sensor to measure tension and caliper of said moving web at a location on said moving web;

providing support for said moving web before and after said location on said moving web where said single sensor measures tension and caliper of said moving web;

controlling said single sensor to alternate between two operating modes where in one of said two operating modes said single sensor measures caliper of said moving web and in another of said two operating modes said single sensor measures tension of said moving web; and wherein said single sensor has first and second sensing planes on opposite sides of said moving web and said controlling said sensor to alternate between said two operating modes comprises extending in one of said two operating modes both said first and said second sensing planes to measure caliper of said moving web and extending in the other of said operating modes only said first sensing plane to measure tension of said moving web.

2. The method of claim 1 further comprising causing said single sensor to move transversely across said moving web.

3. The method of claim 1 wherein said single sensor is controlled upon demand or at predetermined intervals to alternate between said two operating modes.

4. The method of claim 1 further comprising controlling air pressure to said single sensor to thereby cause said single sensor to alternate between said two operating modes.

5. The method of claim 4 wherein said controlling of air pressure to said single sensor further comprises controlling said air pressure in one of said two operating modes to extend both said first and said second sensing planes to measure caliper of said moving web and controlling air pressure to only said first sensing plane to measure tension of said moving web.

6. The method of claim 4 further wherein said air pressure to said single sensor is adjustably controlled.

7. The method of claim 1 wherein said moving web has a predetermined thickness and said sensor is controlled in said other operating mode to extend only said first sensing plane to lightly touch said moving web to thereby deflect said moving web by an amount that is larger than said predetermined web thickness.

8. A method for measuring both tension and caliper of a moving web using a single sensor, the method comprising:

providing a single sensor having first and second sensing planes on opposed sides of the moving web;

controlling said single sensor to alternate between at least two operating modes, in one of said at least two operating modes said single sensor measures caliper of said moving web by extending both said first and second sensing planes to contact the moving web and in another of said at least two operating modes said single sensor measures tension by extending only said first sensing plane to contact the moving web.

9. The method of claim 8 further comprising controlling air pressure to said single sensor to cause said single sensor to alternate between said at least two operating modes.

10. The method of claim 8 wherein the moving web has a predetermined thickness and said single sensor, when measuring tension, extends said first sensing plane to contact the moving web to thereby deflect the moving web by an amount that is larger than said predetermined web thickness, the deflection of the moving web correlating to the tension of the moving web.

* * * * *